US006536345B1

(12) United States Patent
Young

(10) Patent No.: US 6,536,345 B1
(45) Date of Patent: Mar. 25, 2003

(54) PRINTING ON THE SURFACE OF EDIBLE SUBSTRATES

(75) Inventor: Robert John Young, Orpington (GB)

(73) Assignee: Cadex Limited, Tower Bridge (GB)

( * ) Notice: Subject to any disclaimer, the term of this patent is extended or adjusted under 35 U.S.C. 154(b) by 0 days.

(21) Appl. No.: 09/550,974

(22) Filed: Apr. 17, 2000

Related U.S. Application Data

(63) Continuation-in-part of application No. 08/930,485, filed as application No. PCT/GB96/00229 on Feb. 2, 1996.

(30) Foreign Application Priority Data

Jul. 29, 1994 (GB) ..... 9415333

(51) Int. Cl.[7] ..... B41F 1/34; B41J 23/00; B41J 25/308; B41J 2/315

(52) U.S. Cl. ..... 101/485; 101/483; 101/42; 101/488; 101/491; 347/37; 347/8; 347/106; 400/120.16; 400/55; 400/86; 400/76

(58) Field of Search ..... 118/14; 347/8, 347/37; 355/3; 400/120.16, 55, 56; 101/491, 42, 488, 483, 485

(56) References Cited

U.S. PATENT DOCUMENTS

| | | | | |
|---|---|---|---|---|
| 4,168,662 A | | 9/1979 | Fell | 101/426 |
| 4,585,484 A | | 4/1986 | Haruta et al. | 106/22 |
| 4,664,507 A | * | 5/1987 | Fukae et al. | 355/3 |
| 4,910,661 A | | 3/1990 | Barth et al. | 364/167.01 |
| 4,920,422 A | | 4/1990 | Lapierre | 358/296 |
| 4,930,018 A | | 5/1990 | Chan et al. | 358/298 |
| 4,940,998 A | | 7/1990 | Asakawa | 346/140 |
| 5,012,257 A | | 4/1991 | Lowe et al. | 346/1.1 |
| 5,021,802 A | | 6/1991 | Allred | 346/1.1 |
| 5,031,050 A | | 7/1991 | Chan | 358/298 |
| 5,118,351 A | | 6/1992 | Shirota et al. | 106/22 |
| 5,397,387 A | | 3/1995 | Deng et al. | 106/26 R |
| 5,453,121 A | | 9/1995 | Nicholls et al. | 106/20 B |
| 5,463,412 A | | 10/1995 | Matsuda | 347/43 |
| 5,487,614 A | | 1/1996 | Hale | 400/120.02 |
| 5,500,662 A | | 3/1996 | Watanabe | 347/43 |
| 5,505,775 A | * | 4/1996 | Kitos | 118/14 |
| 5,543,177 A | | 8/1996 | Morrison et al. | 427/288 |
| 5,795,395 A | * | 8/1998 | Ben-Matitayhu et al. | |
| 5,806,996 A | * | 9/1998 | Leys et al. | 400/120.16 |
| 6,058,843 A | | 5/2000 | Young | 101/483 |
| 6,059,392 A | * | 5/2000 | Park | 347/8 |

FOREIGN PATENT DOCUMENTS

| | | |
|---|---|---|
| EP | 0348 181 A2 | 12/1989 |
| GB | 2291838 | 2/1996 |
| WO | WO 92/14795 | 9/1992 |
| WO | WO 96/02598 | 2/1996 |

* cited by examiner

*Primary Examiner*—Ren Yan
*Assistant Examiner*—Marvin P Crenshaw
(74) *Attorney, Agent, or Firm*—Townsend and Townsend and Crew LLP

(57) ABSTRACT

Apparatus and a method for printing an image on an edible substrate is described. The apparatus comprises a printer head assemble having a container or containers for liquid food colorant. A support for holding an edible substrate adjacent a print head assembly is provided, which support is adjustable such that the surface thereof upon which an edible substrate is placed may be moved in a direction vertically towards and away from the print head assembly. The support and print head assembly are movable laterally relative to one another. A controller is provided for controlling the print head assembly with printing instructions and for controlling relative movement of the support and print head assembly such that an image to be printed on the edible substrate may be printed. The support comprises upper and lower plates, the upper plate being supported in the lower by a scissors mechanism enabling the height of the upper plate relative to the lower to be adjusted.

11 Claims, 4 Drawing Sheets

PRINTING ON THE SURFACE OF EDIBLE SUBSTRATES

This application is a continuation-in-part of application Ser. No. 08/930,485, filed Sep. 3, 1997, which is a 371 of PCT/GB96/00229 filed Feb. 2, 1996, the complete disclosure of which is herein incorporated by reference.

BACKGROUND OF THE INVENTION

The invention relates to apparatus and a method of printing on edible substrates, and more particular but not exclusively, to apparatus and a method of printing polychromatic or monochromatic images on edible substrates using food dies or edible inks.

Throughout this specification and in the claims annexed hereto to the term "image" is to be taken to refer to any polychromatic or monochromatic design, picture, text pattern or the like to be produced by the apparatus of the invention.

Decorated cakes are well known and have been decorated for many years by hand and examples of methods currently in use include hand printing of a design, spraying a food colorant through a stencil, cutting out shapes from soft icing or marzipan, piping designs (with molten chocolate or soft icing), applying plastic or other types of novelty directly to the surface of the cake, silk screening images onto plaques of sugar or water fixed to the cake.

Most celebration cakes are decorated by hand and rely on the skill and dexterity of the operative to achieve high quality results. These types of decorated cakes are, however, expensive and time consuming to produce because of the skilled labour involved moreover, no equipment is known to exist to produce a commercially viable product by hand with fine detail together with a multiplicity of colours or fine shading.

Attempts have been made to automate the decoration of cakes and other edible substrates. One such attempt is to be found in U.S. Pat. No. 4,910,661 which describes a method and apparatus for capturing live video images which are displayed on a monitor, the images then being mixed with textual matter and other artwork. After editing, the displayed video image may be reproduced on a cake by means of applicators such as airbrushes for applying liquid food colorants and dispensers for applying icing or decorating gel to the cake carried on an XY table moved systematically of the top of the cake.

SUMMARY OF THE INVENTION

One aspect of the invention provides apparatus for printing an image on an edible substrate. The apparatus comprises a print head assembly including one or more containers for holding liquid food colorants, and a support for holding an edible substrate adjacent the print head assembly. The support is adjustable such that a surface of the support upon which an edible substrate is placed may be moved vertically towards and away from the print head assembly. The support and print head assembly are also movable laterally, relative to one another. A controller is provided for controlling the print head assembly with printing instructions and for causing the relative lateral movement. In this way, the colorants are ejected on to the edible substrate at appropriate locations to print the desired image.

Thus, the invention permits both relative lateral movement of the print head assembly and the edible substrate (e.g., in both the X and Y directions), and vertical movement of the print head assembly relative to the substrate, e.g., in the Z direction. By providing relative vertical movement, the position of the surface being printed upon may be adjusted in view of different thicknesses of the edible substrates which might be processed in the apparatus of the invention.

In one particular aspect, the support for the edible substrate may have an upper plate supported above a carrier by an adjuster operable to enable the spacing of the upper plate from the carrier to be adjusted.

The support may comprise a lower plate which in use rests on the corner, the adjusts being operable to the way of the spacing of the upper and lower plates.

The adjuster may advantageously comprise a scissors mechanism acting between the upper and lower plates of the support or between the upper plate and the carrier and may include two pairs of pivotally connected arms, a first end of one arm from each pair of arms is pivotally mounted on a member fixed to the lower support plate and the other ends of which support a rotatable member bearing against the upper support plate. Further, a first end of the other arm in each pair is pivotally coupled to a member movable relative to the lower support plate or carrier and the other ends of which support a rotatable member bearing on the lower support plate.

The pivotal connections of the first end of said one arm of each pair of arms may be fixed to a cross member which is fixed to and carried on the lower support plate and the pivotal connection of the first end of the other arm of each pair of arms is fixed to a second cross member. Further, the second cross member may have a threaded aperture through which a set screw is received to bear against the first cross member. In this way, adjustment of the screw in the threaded aperture adjusts the spacing of the second and first cross members.

Relative lateral movement of the print head assembly and the support may be effected by a pair of stepping motors. For example, a first of the stepping motors may be arranged to drive the print head assembly along a carriageway in a first (X) direction relative to the support for the edible substrate, and the second of the stepping motors may be arranged to drive the support, with the edible substrate in a second (Y) direction substantially normal to the first.

Power may be applied to the second stepping motor only when it is desired to move said support.

The apparatus may further include means for controlling use of copyright images. For example, the apparatus may include means adapted to monitor for a copyright holder the number of times a copyright image is printed and may further be adapted to limit the ability to recolor copyright images.

In a second aspect the invention provides a method for printing an image on an edible substrate. According to the method, the edible substrate is placed on a support. A print head assembly including one or more containers that hold a liquid food colorant is placed adjacent and above the edible food substrate, the position of the support is vertically adjusted such that the surface of the edible substrate that is to be printed upon is at a desired distance from the print head assembly. Movement of the support and print head assembly laterally relative to one another are controlled while operating the print head assembly to eject the food colorant on to the substrate based on printing instructions to print the desired image on the edible substrate.

With advantage the method may further include the step of controlling copyright images in the printing process. In this way, a user may be prevented from printing certain copyright imaged.

The method may include monitoring the number of times a copyright image is printed and/or permitting the ability to recolor images which are copyright.

DESCRIPTION OF THE SPECIFIC EMBODIMENTS

The invention provides exemplary apparatus and methods for printing images onto edible substrates. The apparatus and methods of the invention may employ the use of a support onto which the edible substrate may be placed. Further, a print head assembly is provided for ejecting various liquid colorants onto edible substrate to produce a desired image.

In one aspect of the invention, the support is configured to be vertically moveable relative to the print head assembly. In this way, the distance between the print head assembly and the edible substrate may be varied. In this manner, an optimum distance may be achieved between the print head assembly and the edible substrate regardless of the thickness of the edible substrate, thereby maximising the efficiency and operability and operability of the print head assembly.

In another aspect of the print head assembly and the support are laterally moveable relative to each other. In this way, the print head assembly may be moved over essentially any location of the edible substrate. Hence, by using appropriate software, different colours of the food colorant may be ejected over appropriate locations of the edible substrate to produce the image. Merely by way of example, the support may be moveable along an X axis while the print head assembly is movable along a Y axis. Conveniently, a controller may be employed to control positioning of the print head assembly in an X-Y plane to control ejection of the food colorant from the print head assembly to produce the desired image.

Figure 1:
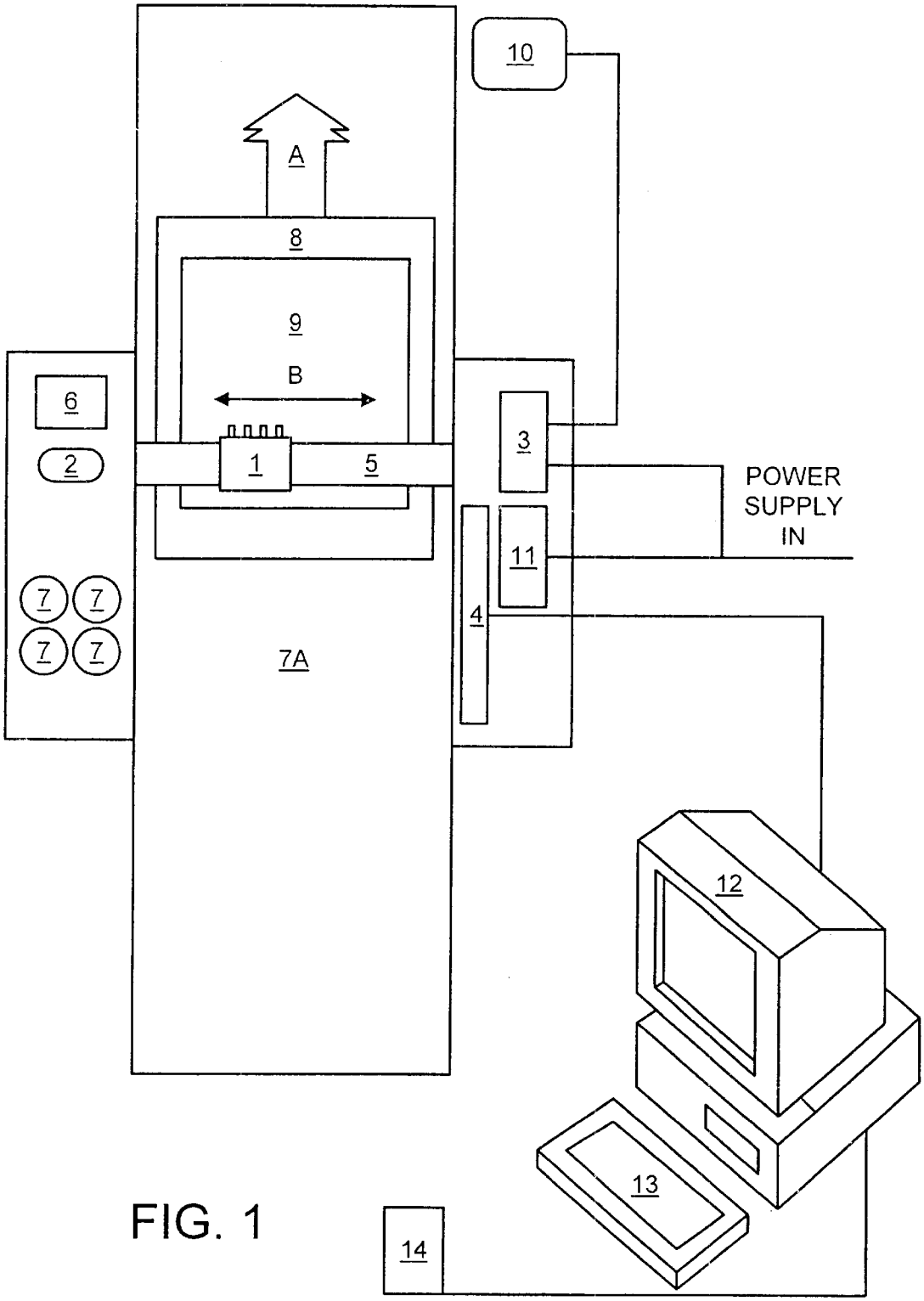
FIG. 1 is a schematic representation of apparatus embodying the invention.

With reference now to the drawings, FIG. 1 shows a bubble-jet printer head assembly 1 together with a stepping motor 2 for moving the print head assembly. The stepping motor 2 is connected to a power supply 11. It will be appreciated that other types of print head assembly may be used.

A logic board 4 controls the stepping motor 2 and thus movement of the printer head assembly 1 along a carriageways 5 in the directions of the double headed arrows A, that is to say along the X axis.

A pump 6 is provided to both clean the bubble-jet assembly 1 and to deliver liquid food colorant to the assembly from a complex of reservoirs 7. A carrier 7A is provided to move support 8 in the direction of the arrow B, that is to say along the Y axis, upon which an edible substrate 9 may be placed. A second stepping motor 10 is connected to a dedicated power supply 3 and to the logic board 4 which controls its operation. The stepping motor 10 is operable to advance the support 8 as required.

An image to be printed on an edible substrate 9 is stored on electronically accessible (e.g. a compact disc or magnetic storage device) media held within a computer processor 12 and is accessed by entering the required image code via touch screen, a keyboard, a key pad or pointing device 13. If the image is subject to copyright it may optionally be protected by an encryption algorithm and may be decrypted by means of a smart card reader 14. The system may include logic circuitry adapted to monitor the number of times a copyright image is used. The logic circuitry may also enable the colors of stored images, as printed, to be changed. Further a change in colors of a copyright image may be prevented if the copyright owner so desires.

To enable the apparatus to scan an image using the scanner the user must first insert in the apparatus a smart card encrypted with the hardlock serial number (an eleven digit code) unique to the piece of apparatus and carrying a credit count. The action is needed to enable the software to scan the image into a format usable to drive and control the print head assembly ensuring the desired image is properly printed upon the edible substrate. The software then allows the user to crop the image, adjust the brightness and contrast of the image, alter the hue of the image of the image, and generally change the image to what is desired. When the user causes the image to be printed on an edible substrate the software reduces the credit count by one.

A user may also use the apparatus to print copyright images supplied to him. There may be supplied in any appropriate electronically accessible form, for example on a compact disc. In this case, the apparatus is provided with a CD-ROM drive and the user may place into this drive a CD carrying the copyright images. The CD has a unique volume name (UVN). The user must also then place into the apparatus a second smart card he has purchased carrying the encrypted hard lock serial number (the eleven-digit code) specific to the piece of apparatus, the UVN for the specific CD being used and a number of credits. The number of credits may lie in the range 1–4000, but is usually 250 when the smart card is initially supplied. The user may then select a desired copyright image for use. Manipulate the hue of the image, adjust the brightness and contrast of the image, crop the image; but the software will not allow any changes in the specific colours of the image or other changes to the image. When the user causes the image to be printed on an edible substrate the software reduces the number of credits by one.

It will be appreciated that in this way the rights of the owner of the copyright in the images is preserved and that he is properly recompensed for their use. Any suitable smart cards may be employed.

The image once selected and adjusted (if desired) is sent to the print head assembly 1 via the logic board 4 as a bit map, raster image, postscript or other suitable image file. In response, the print head assembly 1 is driven to move along the carriageway 5 on the X axis by stepping motor 2 and to deposit colorant taken from the complex of reservoirs 7 at predetermined positions across the top of the edible substrate 9. When the print head assembly 1 reaches the end of the carriageway 5 the logic board 4 causes the second stepping motor 10 to advance the support 8 carrying the substrate 9 by a predetermined amount along the Y axis (perhaps one quarter of an inch). The logic board 4 thereafter causes stepping motor 2 to drive the print head assembly 1 along the X axis in other direction along carriageway 5 until it reaches the other end of the carriageway. In moving along the carriageway 5 the print head assembly, again, deposits food colorant onto the edible substrate 9.

This process is continued until the required image has been created on the edible substrate.

Figure 2A:
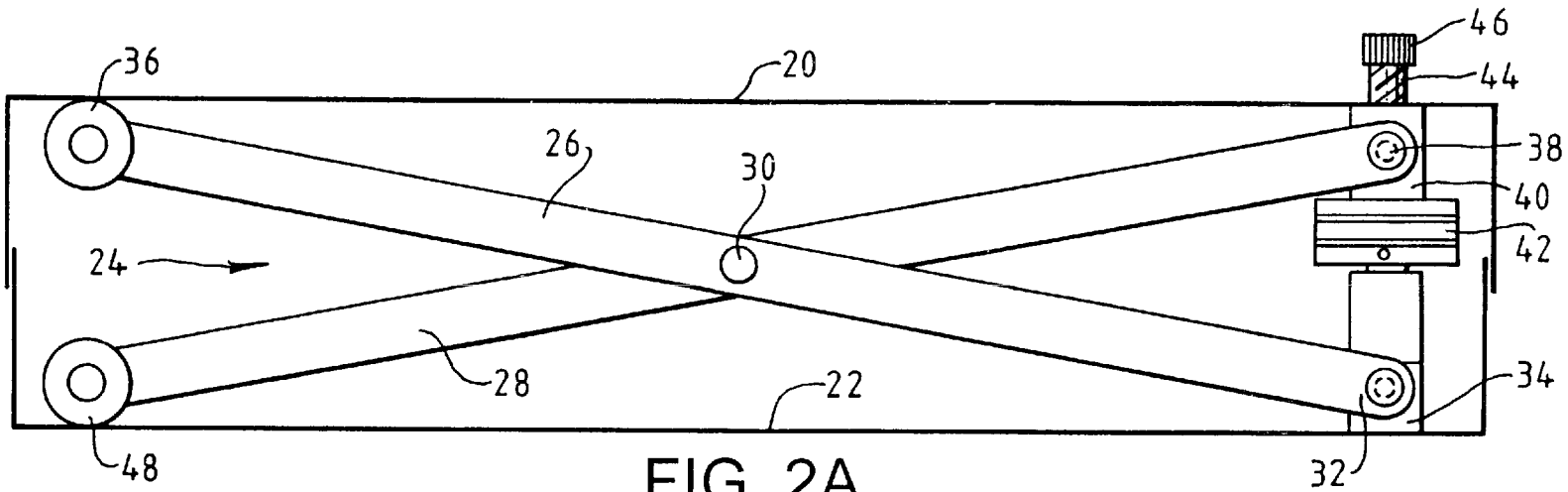
FIG. 2 shows at A and B respectively more detailed sectional side and end views of part of the apparatus of FIG. 1.
Figure 2B:
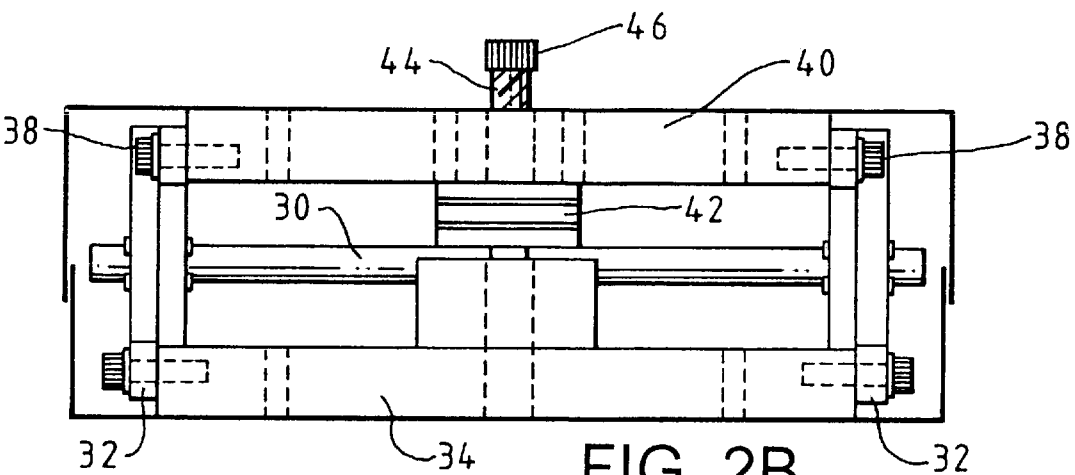

Support 8 has the form shown in FIGS. 2A and 2B and comprises an upper plate 20 upon which the edible substrate 9 is placed. The upper plate 20 of support 8 is spaced from a lower plate 22 on the support by a height adjusting scissors mechanism 24. This scissors mechanism 24 comprises two pairs of arms each pair 26, 28 being pivotally linked to one another at 30.

A first end 32 of each arm 26 is pivotally supported on a first cross member fixedly mounted on the lower plate 22 of the support. The other ends of those arms are coupled to opposite ends of roller 36 which bears against the upper plate 20 of the support.

The other arm 28 of each pair is pivotally linked at 38 to a second cross member 40 supported by a thrust bearing 42 on the first cross member 34. Cross member 40 has a threaded through bore receiving a screw 44 with a knurled head 46. The other ends of the arms 28 are coupled to opposite ends of a roller 48 bearing against the lower plate 22 of the support.

It will be appreciated that rotation of the screw 44 will cause relative movement of the cross members 40 and 34. Because of the pivotal interconnection of the arms 26, 28 of the adjusting mechanism 24 this will result in relative movement of the upper and lower plates 20 and 22. Plate 22 is supported at a fixed level in the apparatus and so plate 20 of the support will be moved along the Z axis toward or away from the print head assembly 1 of the apparatus.

In this way account may be taken of different thickness of edible substrate which may be printed upon using the apparatus.

It will further be seen that the stepping motor 10 has a significant amount of work to do in moving the edible substrate and the support past the print head. In order to ensure that the stepping motor does not overheat it is preferred that it be associated with a large heat sink, and that it be energised, via the logic board 4, only when it is required to move the edible substrate relative to the print head.

It is preferred that the complex of reservoirs 7 comprise at least 4 containers housed in a compartment within the casing of the apparatus, each containing a food colorant of a different colour. The food colorant can of course be black, white or any other color. It is preferred, however, that the four reservoirs contain Yellow, Magenta, Cyan and Black colorants respectively. Each reservoir supplies a separate and distinct printing head; in this way it is possible to print a multiplicity of colours which is not possible with machines having a common reservoir.

In general the apparatus will also include associated elements such as a power supply, a control panel, a logic board and associated wiring.

Any suitable means may be provided to operate the machine e.g. a computer keyboard or pointing device.

A movable carrier 7A is provided to move the support 8 for the edible substrate e.g. a tray, conveyor belt or rollers. Any suitable way of moving the support 8 holding the edible substrate along the Y axis, longitudinally of the apparatus, may be employed, e.g. by means of a conveyor belt, chain drive, rollers or the like. The bubble-jet printer head assembly is movable transversely of the direction of movement of the carrier 7A and support 8 some 2–10 mm above the edible substrate 9. In this way the print head assembly will not contact the edible substrate. As the height of the support 8 may be varied, apparatus embodying the invention can print upon an edible substrates of different thicknesses.

Making use of apparatus as described above, virtually unskilled operatives can produce decorated cakes to a high resolution in a multiplicity of colours e.g. 360×260 dots per square inch and in 16.7 million colours.

The area of the edible substrate to be decorated can be from a small dot up to a maximum size the print head assembly will allow.

Apparatus embodying the invention may be used in conjunction with any suitable edible substrate, e.g. royal icing, gum paste, sugar paste, fresh cream, cover paste, ice cream, butter cream, water, rice paper, gelatine, marzipan, fondant, American frosting, meringue, boiled icing, chocolate, boiled sugar, confectioners cream, custard, blancmange, cheesecake filing, pastry, pastilliage, nut paste, water, biscuit, cheese, potato, paste, etc.

Figure 3:
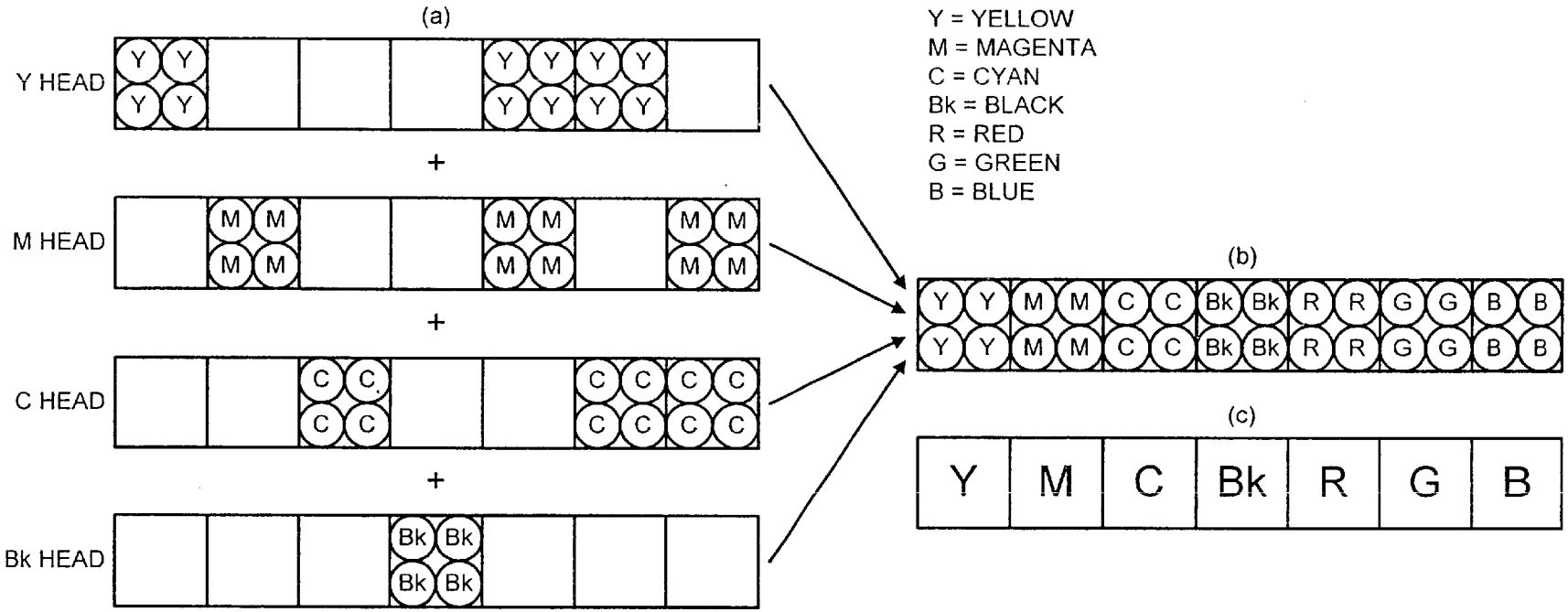
FIG. 3 is a diagrammatic representation of a method of obtaining polychromatic output from the apparatus of FIG. 1.

Referring to FIG. 3 there is shown a method by which small dots of different colorant may combine to give a plurality of different colours. The print head 1 (FIG. 1) moves over the surface of the edible substrate 9 and each head deposits flying droplets of colorant which are discharged towards the edible substrate according to the instructions received from the computer 12 (FIG. 1). As noted the preferred colours are Yellow, Magenta, Cyan and Black which when combined on the edible surface in varying proportions enable the production of polychromatic images to be produced and not just monochromatic images as would be produced by machines that have a single colour head.

Figure 4:
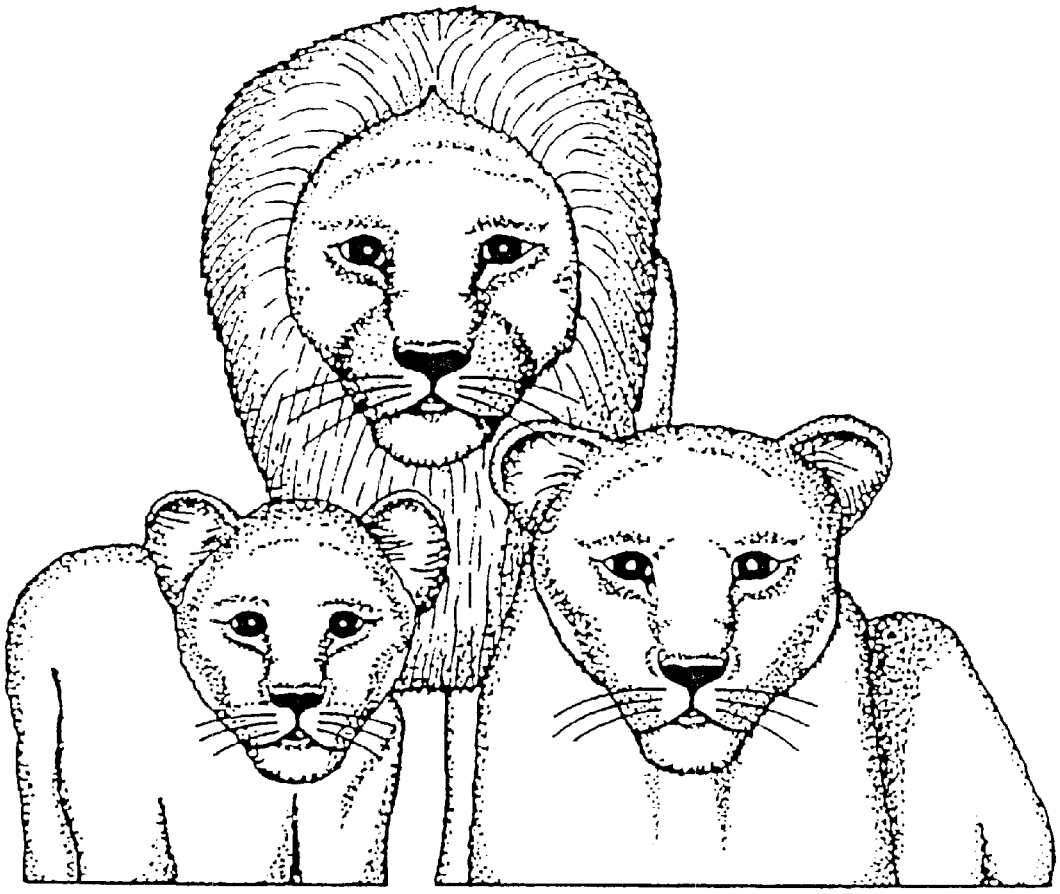
FIG. 4 is an example of the output of the apparatus of FIG. 1.

FIG. 4 shows an example of the output of the machine in FIG. 1. It will be seen that it is an incredibly intricate picture of three Lions. This is a higher quality image than has previously been obtainable on an edible substrate.

The apparatus and method now proposed enables individual designs to be produced to the same or better standard than has hitherto been commercially feasible and at a fraction of the labour and material cost.

The apparatus and method of the invention can operate to apply polychromatic as well as monochromatic images effectively onto edible substrates.

It will also be understood that the foregoing is capable of variation without departing from the spirit and scope of the present invention. For example, the particular mechanism shown for moving the upper support plate relative to the lower support plate (and thus adjusting the position of the edible substrate along the Z axis) may be varied and further may be incorporated in a system (e.g. using an LED and a photo receiving diode) which automatically adjusts the height of the support to take account of edible substrates of different thickness'.

It will be appreciated that although the specific description above refers to the use of a liquid food colorant other forms for food colorants may be used with appropriate forms of print head assembly. For example food colorants which are in the forms of powders or pellets may be used if desired.

I claim:

1. Apparatus for printing an image on to an edible substrate, the apparatus comprising a print head assembly including at least one container that is adapted to hold a food colorant;

a support having a surface that is adapted to hold the edible substrate adjacent the print head assembly, the support being adjustable such that the surface that is adapted to hold the edible substrate may be moved vertically towards and away from the print head assembly, the support and print head assembly being laterally moveable relative to one another;

a controller to control operation of the print head assembly with printing instructions and to cause said relative lateral movement in accordance with an image that is adapted to be printed upon the edible substrate; and means for controlling use of copyright images, the means for controlling being adapted to monitor for a copyright holder the number of times a copyright image is printed.

2. Apparatus as claimed in claim 1, further comprising a carrier for the support, the support comprising an upper plate, upon which the edible substrate is placed and an adjuster operable to enable the spacing of the upper plate and carrier to be adjusted.

3. Apparatus as claimed in claim 2, wherein the support comprises upper and lower plates, the lower plate being adapted to rest on the carrier in use.

4. Apparatus as claimed in claim 3, wherein said adjuster comprises a scissors mechanism acting between the upper and lower plates of the support and includes two pairs of pivotally connected arms, a first end of one arm of each pair of army is pivotally mounted on a member fixed to the lower support plate and the other ends of which support a rotatable member bearing against the upper support plate, whilst a first end of the other arm in each pair is pivotally coupled to a member moveable relative to the lower support plate and the other ends of which support a rotatable member bearing on the lower support plate.

5. Apparatus as claimed in claim 4, wherein the pivotal connections of the first end of said one arm of each pair of arms is fixed to a first cross member which is fixed to and carried on the lower support plate and the pivotal connection of the first end of the other arm of each pair of arms is fixed to a second cross member, said second cross member having a threaded aperture receiving a set screw passing therethrough to bear against the first cross member, wherein adjustment of the screw in said threaded aperture adjusts the spacing of the cross member.

6. Apparatus as claimed in claim 5, further comprising a pair of stepping motors, wherein relative lateral movement of the print head assembly and the support is effected by the pair of stepping motors, wherein a first of said stepping motors is arranged to drive the print head assembly along a carriageway in a first direction (X) relative to the support and a second of the stepping motors being arranged to drive the support, in a second direction (Y) substantially normal to the first direction.

7. Apparatus as claimed in claim 6, wherein said controller applies power to said second stepping motor only when it is desired to move said support.

8. Apparatus as claimed in claim 1, wherein the means for controlling is adapted to limit the ability to recolor copyright images.

9. A method of printing an image on an edible substrate the method comprising:

placing an edible substrate on a support;

locating a print head assembly including at least one container having a food colorant above and adjacent the edible food substrate;

vertically adjusting the position of the support relative to the print head assembly such that a surface of the edible substrate to be printed thereon is at a certain distance from the print head assembly;

controlling lateral movement of the support and print head assembly relative to each other while ejecting the food colorant on to the surface of the edible substrate such that a desired image is printed on the edible substrate, and monitoring the number of times a copyright image is printed.

10. A method as claimed in claim 9, further including the step of controlling the printing of copyright images in the printing process.

11. A method as claimed in claim 9, further including the step of controlling the amount by which copyright images may be recolored.

* * * * *